US006099960A

United States Patent [19]

Tennent et al.

[11] Patent Number: 6,099,960

[45] Date of Patent: Aug. 8, 2000

[54] HIGH SURFACE AREA NANOFIBERS, METHODS OF MAKING, METHODS OF USING AND PRODUCTS CONTAINING SAME

[75] Inventors: Howard Tennent, Kenneth Square; David Moy, Winchester; Chun-Ming Niu, Somerville, all of Mass.

[73] Assignee: Hyperion Catalysis International, Cambridge, Mass.

[21] Appl. No.: 08/854,918

[22] Filed: May 13, 1997

Related U.S. Application Data

[60] Provisional application No. 60/017,787, May 15, 1996.

[51] Int. Cl.[7] ..... D02G 3/00

[52] U.S. Cl. ..... 428/367; 428/400; 428/398

[58] Field of Search ..... 428/367, 375, 428/398, 400

[56] References Cited

U.S. PATENT DOCUMENTS

| | | | |
|---|---|---|---|
| 4,013,751 | 3/1977 | Davis et al. | 102/157 R |
| 4,992,332 | 2/1991 | Kamei et al. | 428/398 |
| 5,171,560 | 12/1992 | Tennent | 428/367 |
| 5,569,635 | 10/1996 | Moy et al. | 502/185 |
| 5,681,657 | 10/1997 | Frey et al. | 428/375 |
| 5,747,161 | 5/1998 | Iijima | 428/367 |
| 5,863,654 | 1/1999 | Frey et al. | 428/375 |
| 5,866,424 | 2/1999 | Massey et al. | 436/526 |

*Primary Examiner*—Newton Edwards
*Attorney, Agent, or Firm*—Whitman Breed Abbott & Morgan LLP

[57] ABSTRACT

A high surface area carbon nanofiber is provided. The carbon nanofiber has an outer surface on which a porous high surface area layer is formed. A method of making the high surface area carbon nanofiber includes pyrolizing a polymeric coating substance provided on the outer surface of the carbon nanofiber at a temperature below the temperature at which the polymeric coating substance melts. The polymeric coating substance used as the high surface area around the carbon nanofiber may include phenolics-formaldehyde, polyacrylonitrile, styrene, divinyl benzene, cellulosic polymers and cyclotrimerized diethynyl benzene. The high surface area polymer which covers the carbon nanofiber may be functionalized with one or more functional groups.

21 Claims, 3 Drawing Sheets

END VIEW

FIBRIL AS MADE

POLYMER COATED FIBRIL

PYROLYZED POLYMER COATED FIBRIL

ACTIVATED PYROLYZED POLMER COATED FIBRIL

HIGH SURFACE AREA NANOFIBERS, METHODS OF MAKING, METHODS OF USING AND PRODUCTS CONTAINING SAME

This application claims benefit to U.S. Provisional Application 60/017,787 filed May 15, 1996, which is now abandoned.

FIELD OF THE INVENTION

The invention relates generally to high surface area nanofibers. More specifically, the invention relates to nanofibers which are coated with a substance, derived by pyrolysis of a polymer, in order to increase the surface area of the nanofibres. More specifically still, the invention relates to graphitic carbon nanofibers coated with a graphenic carbon layer derived by pyrolysis of a polymer. The graphenic layer can also be activated by known activation techniques, functionalized, or activated and then functionalized, to enhance its chemical properties.

BACKGROUND OF THE INVENTION

A number of applications in the chemical arts require a substance which embodies, to the greatest extent possible, a high surface area per unit volume, typically measured in square meters per gram. These applications include, but are not limited to catalyst support, chromatography, chemical adsorption/absorption and mechanical adsorption/absorption. These applications generally require that a high degree of interaction between a liquid or gaseous phase and a solid phase; for instance, a catalyst support which requires that a maximum amout of reagents contact a catalyst in the quickest amount of time and within the smallest possible space, or a chromatagraphic technique wherein maximum separation is desired using a relatively small column.

More specifically regarding catalysts, heterogeneous catalytic reactions are widely used in chemical processes in the petroleum, petrochemical and chemical industries. Such reactions are commonly performed with the reactant(s) and product(s) in the fluid phase and the catalyst in the solid phase. In heterogeneous catalytic reactions, the reaction occurs at the interface between phases, i.e., the interface between the fluid phase of the reactant(s) and product(s) and the solid phase of the supported catalyst. Hence, the properties of the surface of a heterogeneous supported catalyst are significant factors in the effective use of that catalyst. Specifically, the surface area of the active catalyst, as supported, and the accessibility of that surface area to reactant chemisorption and product desorption are important. These factors affect the activity of the catalyst, i.e., the rate of conversion of reactants to products. The chemical purity of the catalyst and the catalyst support have an important effect on the selectivity of the catalyst, i.e., the degree to which the catalyst produces one product from among several products, and the life of the catalyst.

Generally catalytic activity is proportional to catalyst surface area. Therefore, high specific area is desirable. However, that surface area must be accessible to reactants and products as well as to heat flow. The chemisorption of a reactant by a catalyst surface is preceded by the diffusion of that reactant through the internal structure of the catalyst.

Since the active catalyst compounds are often supported on the internal structure of a support, the accessibility of the internal structure of a support material to reactant(s), product (s) and heat flow is important. Porosity and pore size distribution of the support structure are measures of that accessibility. Activated carbons and charcoals used as catalyst supports have surface areas of about 1000 square meters per gram and porosities of less than one milliliter per gram. However, much of this surface area and porosity, as much as 50%, and often more, is associated with micropores, i.e., pores with pore diameters of 2 nanometers or less. These pores can be inaccessible because of diffusion limitations. They are easily plugged and thereby deactivated. Thus, high porosity material where the pores are mainly in the mesopore (>2 nanometers) or macropore (>50 nanometers) ranges are most desirable.

It is also important that supported catalysts not fracture or attrit during use because such fragments may become entrained in the reaction stream and must then be separated from the reaction mixture. The cost of replacing attritted catalyst, the cost of separating it from the reaction mixture and the risk of contaminating the product are all burdens upon the process. In other processes, e.g. where the solid supported catalyst is filtered from the process stream and recycled to the reaction zone, the fines may plug the filters and disrupt the process.

It is also important that a catalyst, at the very least, minimize its contribution to the chemical contamination of reactant(s) and product(s). In the case of a catalyst support, this is even more important since the support is a potential source of contamination both to the catalyst it supports and to the chemical process. Further, some catalysts are particularly sensitive to contamination that can either promote unwanted competing reactions, i.e., affect its selectivity, or render the catalyst ineffective, i.e., "poison" it. Charcoal and commercial graphites or carbons made from petroleum residues usually contain trace amounts of sulfur or nitrogen as well as metals common to biological systems and may be undesirable for that reason.

Since the 1970s nanofibers have been identified as materials of interest for such applications. Carbon nanofibers exist in a variety of forms and have been prepared through the catalytic decomposition of various carbon-containing gases at metal surfaces. Such vermicular carbon deposits have been observed almost since the advent of electron microscopy. A good early survey and reference is found in Baker and Harris, *Chemistry and Physics of Carbon,* Walker and Thrower ed., Vol. 14, 1978, p. 83, hereby incorporated by reference. See also, Rodriguez, N., *J. Mater. Research, Vol.* 8, p. 3233 (1993), hereby incorporated by reference.

Nanofibers such as fibrils, bucky tubes and nanofibers are distinguishable from continuous carbon fibers commercially available as reinforcement materials. In contrast to nanofibers, which have, desirably large, but unavoidably finite aspect ratios, continuous carbon fibers have aspect ratios (L/D) of at least $10^4$ and often $10^6$ or more. The diameter of continuous fibers is also far larger than that of nanofibers, being always >1.0$\mu$ and typically 5 to 7$\mu$.

Further details regarding the formation of carbon nanofiber aggregates may be found in the disclosure of Snyder et al., U.S. patent application Ser. No. 149,573, filed Jan. 28, 1988, and PCT Application No. US89/00322, filed Jan. 28, 1989 ("Carbon Fibrils") WO 89/07163, and Moy et al., U.S. patent application Ser. No. 413,837 filed Sep. 28, 1989 and PCT Application No. US90/05498, filed Sep. 27, 1990 ("Fibril Aggregates and Method of Making Same") WO 91/05089, all of which are assigned to the same assignee as the invention here and are hereby incorporated by reference.

While activated charcoals and other carbon-containing materials have been used as catalyst supports, none have heretofore had all of the requisite qualities of porosity and pore size distribution, resistance to attrition and purity for the conduct of a variety of organic chemical reactions.

Specifically, nanofiber mats, assemblages and aggregates have been previously produced to take advantage of the increased surface area per gram achieved using extremely thin diameter fibers. These structures are typically composed of a plurality of intertwined or intermeshed fibers.

The macroscopic morphology of the aggregate is controlled by the choice of catalyst support. Spherical supports grow nanofibers in all directions leading to the formation of bird nest aggregates. Combed yarn and open nest aggregates are prepared using supports having one or more readily cleavable planar surfaces, e.g., an iron or iron-containing metal catalyst particle deposited on a support material having one or more readily cleavable surfaces and a surface area of at least 1 square meters per gram.

Moy et al., U.S. application Ser. No. 08/469,430 entitled "Improved Methods and Catalysts for the Manufacture of Carbon Fibrils", filed Jun. 6, 1995, hereby incorporated by reference, describes nanofibers prepared as aggregates having various morphologies (as determined by scanning electron microscopy) in which they are randomly entangled with each other to form entangled balls of nanofibers resembling bird nests ("BN"); or as aggregates consisting of bundles of straight to slightly bent or kinked carbon nanofibers having substantially the same relative orientation, and having the appearance of combed yarn ("CY") e.g., the longitudinal axis of each nanofiber (despite individual bends or kinks) extends in the same direction as that of the surrounding nanofibers in the bundles; or, as, aggregates consisting of straight to slightly bent or kinked nanofibers which are loosely entangled with each other to form an "open net" ("ON") structure. In open net structures the degree of nanofiber entanglement is greater than observed in the combed yarn aggregates (in which the individual nanofibers have substantially the same relative orientation) but less than that of bird nests. CY and ON aggregates are more readily dispersed than BN making them useful in composite fabrication where uniform properties throughout the structure are desired.

Nanofibers and nanofiber aggregates and assemblages described above are generally required in relatively large amounts to perform catalyst support, chromatography, or other application requiring high surface area. These large amounts of nanofibers are disadvantageously costly and space intensive. Also disadvantageously, a certain amount of contamination of the reaction or chromatography stream, and attrition of the catalyst or chromatographic support, is likely given a large number of nanofibers.

Aerogels are high surface area porous structures or foams typically formed by supercritical drying a mixture containing a polymer, followed by pyrolysis. Although the structures have high surface areas, they are disadvantageous in that they exhibit poor mechanical integrity and therefore tend to easily break down to contaminate, for instance, chromatographic and reaction streams. Further, the surface area of aerogels, while relatively high, is largely in accessible, in part due to small pore size.

The subject matter of this application, deals with reducing the number of nanofibers needed to perform applications requiring high surface area by increasing the surface area of each nanofiber. The nanofibers of this application have an increased surface area, measured in $m^2/g$, as compared to nanofibers known in the art. Also advantageously, even assuming that a certain number of nanofibers per gram of nanofiber will be contaminant in a given application, the fact that less nanofibers are required for performing that application will thereby reduce nanofiber contamination.

OBJECTS OF THE INVENTION

It is therefore an object of this invention to provide a nanofiber having a high surface area layer containing pores which increase the effective surface area of the nanofiber and thus increases the number of potential chemical reaction or catalytic sites on the nanofiber.

It is another object of this invention to provide a nanofiber having a high surface area layer containing pores which increase the effective surface area of the nanofiber and thus increases the number of potential chemical reaction or catalytic sites on the nanofiberand which nanofibers are capable of forming rigid structures.

It is yet another object of this invention to provide a nanofiber having a high surface area layer containing pores which increase the effective surface area of the nanofiber and thus increases the number of potential chemical reaction or catalytic sites on the nanofiber.

It is yet another object of this invention to provide a composition of matter comprising nanofibers having an activated high surface area layer containing additional pores which further increase the effective surface area of the nanofiber and thus increases the number of potential chemical reaction or catalysis sites on the nanofiber.

It is a further object of this invention to provide a nanofiber having a high surface area layer containing pores which increase the effective surface area of the nanofiber and thus increases the number of potential chemical reaction or catalysis sites on the nanofiber, which also is functionalized to enhance chemical activity.

It is further still an object of this invention to provide a composition of matter comprising nanofiber having an activated high surface area layer containing additional pores which increase the effective surface area of the nanofiber and thus increases the number of potential chemical reaction or catalysis sites on the nanofiber, which also is functionalized to enhance chemical activity.

SUMMARY OF THE INVENTION

The invention encompasses coated nanofibers, assemblages and aggregates made from coated nanofibers, functionalized coated nanofibers, including assemblages and aggregates made from functionalized coated nanofibers, and activated coated nanofibers, including activated coated nanofibers which may be functionalized. The nanofiber made according to the present inventio have increased surface areas in comparison to conventional uncoated nanofibers. The increase in surface area results from the porous coating applied to the surface of the nanofiber. The high surface nanofiber is formed by coating the fiber with a polymeric layer and pyrolyzing the layer to form a porous carbon coating on the nanofiber.

DEFINITIONS

Figure 2:
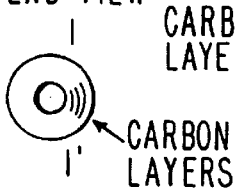
FIG. 2 is a front elevational view of a carbon fibril taken along line 1—1'.
Figure 1:
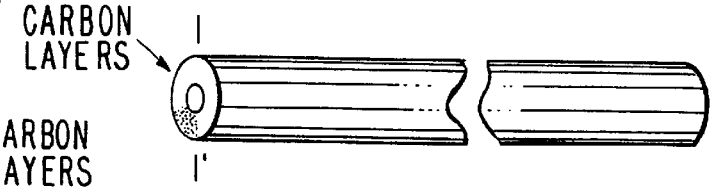
FIG. 1 is a side elevational view of a carbon fibril.
Figure 4:
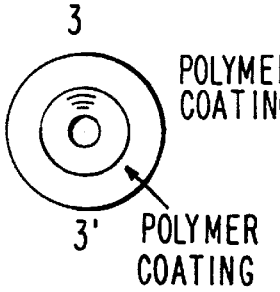
FIG. 4 is a front elevational view of a carbon fibril coated with a polymer taken along line 3—3'.
Figure 3:
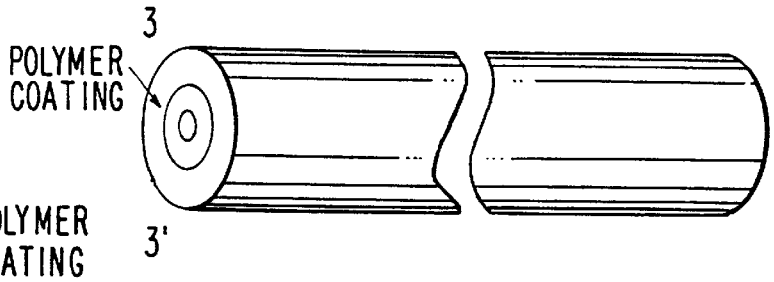
FIG. 3 is a side elevational view of a carbon fibril coated with a polymer.
Figure 6:
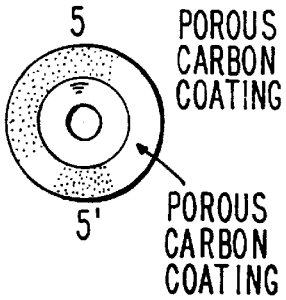
FIG. 6 is a front elevational view of a carbon fibril coated with a polymer after pyrolysis taken along line 5—5'.
Figure 5:
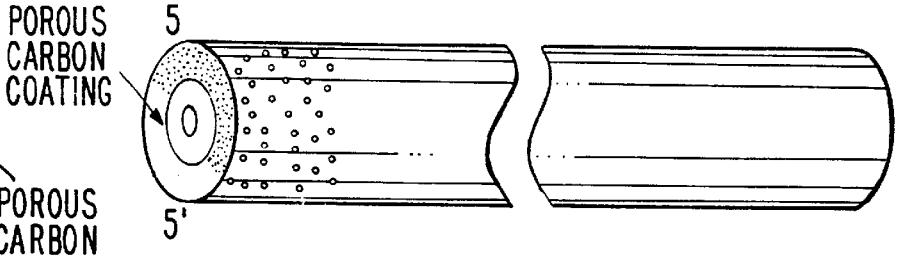
FIG. 5 is a side elevational view of a carbon fibril coated with a polymer after pyrolysis.
Figure 8:
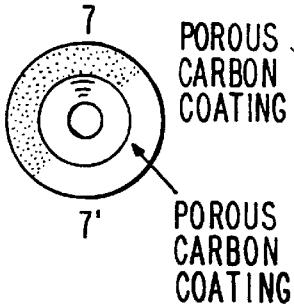
FIG. 8 is a front elevational view of a carbon fibril coated with a polymer after pyrolysis and activation taken along line 7—7'.
Figure 7:
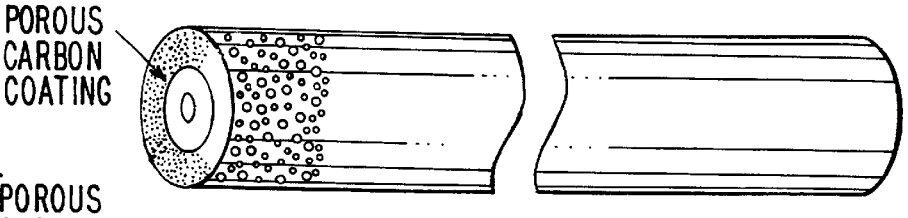
FIG. 7 is a side elevational view of a carbon fibril coated with a polymer after pyrolysis and activation.

The term "effective surface area" refers to that portion of the surface area of a nanofiber (see definition of surface area) which is accessible to those chemical moieties for which access would cause a chemical reaction or other interaction to progress as desired.

"Graphenic" carbon is a form of carbon whose carbon atoms are each linked to three other carbon atoms in an essentially planar layer forming hexagonal fused rings. The layers are platelets only a few rings in diameter or they may be ribbons, many rings long but only a few rings wide. There is no order in the relation between layers, few of which are parallel.

"Graphenic analogue" refers to a structure which is incorporated in a graphenic surface.

"Graphitic" carbon consists of layers which are essentially parallel to one another and no more than 3.6 angstroms apart.

The term "macroscopic" refers to structures having at least two dimensions greater than 1 micrometer.

The term "mesopore" refers to pores having a cross section greater than 2 nanometers.

The term "micropore" refers to a pore which is has a diameter of less than 2 nanometers.

The term "nanofiber" refers to elongated structures having a cross section (e.g., angular fibers having edges) or diameter (e.g., rounded) less than 1 micron. The structure may be either hollow or solid. This term is defined further below.

The term "physical property" means an inherent, measurable property of the nanofiber.

The term "pore" refers to an opening or depression in the surface of a coated or uncoated nanofiber.

The term "purity" refers to the degree to which a nanofiber, surface of a nanofiber or surface of high surface area nanofiber, as noted, is carbonaceous.

The term "pyrolysis" refers to a chemical change in a substance occasioned by the application of heat.

The term "relatively" means that ninety-five percent of the values of the physical property will be within plus or minus twenty percent of a mean value.

The term "substantially" means that ninety-five percent of the values of the physical property will be within plus or minus ten percent of a mean value.

The terms "substantially isotropic" or "relatively isotropic" correspond to the ranges of variability in the values of a physical property set forth above.

The term "surface area" refers to the total surface area of a substance measurable by the BET technique.

The term "thin coating layer" refers to the layer of substance which is deposited on the nanofiber. Typically, the thin coating layer is a carbon layer which is deposited by the application of a polymer coating substance followed by pyrolysis of the polymer.

DETAILED DESCRIPTION OF THE INVENTION

Nanofiber Precursors

Nanofibers are various types of carbon fibers having very small diameters including fibrils, whiskers, nanotubes, bucky tubes, etc. Such structures provide significant surface area when incorporated into macroscopic structures because of their size. Moreover, such structures can be made with high purity and uniformity.

Preferably, the nanofiber used in the present invention has a diameter less than 1 micron, preferably less than about 0.5 micron, and even more preferably less than 0.1 micron and most preferably less than 0.05 micron.

The fibrils, buckytubes, nanotubes and whiskers that are referred to in this application are distinguishable from continuous carbon fibers commercially available as reinforcement materials. In contrast to nanofibers, which have desirably large, but unavoidably finite aspect ratios, continuous carbon fibers have aspect ratios (L/D) of at least $10^4$ and often $10^6$ or more. The diameter of continuous fibers is also far larger than that of fibrils, being always >1.0 $\mu$m and typically 5 to 7 $\mu$m.

Continuous carbon fibers are made by the pyrolysis of organic precursor fibers, usually rayon, polyacrylonitrile (PAN) and pitch. Thus, they may include heteroatoms within their structure. The graphenic nature of "as made" continuous carbon fibers varies, but they may be subjected to a subsequent graphenation step. Differences in degree of graphenation, orientation and crystallinity of graphite planes, if they are present, the potential presence of heteroatoms and even the absolute difference in substrate diameter make experience with continuous fibers poor predictors of nanofiber chemistry.

The various types of nanofibers suitable for the polymer coating process are discussed below.

Carbon fibrils are vermicular carbon deposits having diameters less than 1.0 $\mu$, preferably less than 0.5 $\mu$, even more preferably less than 0.2 $\mu$ and most preferably less than 0.05 $\mu$. They exist in a variety of forms and have been prepared through the catalytic decomposition of various carbon-containing gases at metal surfaces. Such vermicular carbon deposits have been observed almost since the advent of electron microscopy. A good early survey and reference is found in Baker and Harris, *Chemistry and Physics of Carbon, Walker and Thrower ed., Vol.* 14, 1978, p. 83 and Rodriguez, N., *J. Mater. Research,* Vol. 8, p. 3233 (1993), each of which are hereby incorporated by reference. (see also, Obelin, A. and Endo, M., *J. of Crvstal Growth,* Vol. 32 (1976), pp. 335–349, hereby incorporated by reference).

U.S. Pat No. 4,663,230 to Tennent, hereby incorporated by reference, describes carbon fibrils that are free of a continuous thermal carbon overcoat and have multiple ordered graphenic outer layers that are substantially parallel to the fibril axis. As such they may be characterized as having their c-axes, the axes which are perpendicular to the tangents of the curved layers of graphite, substantially perpendicular to their cylindrical axes. They generally have diameters no greater than 0.1 $\mu$ and length to diameter ratios of at least 5. Desirably they are substantially free of a continuous thermal carbon overcoat, i.e., pyrolytically deposited carbon resulting from thermal cracking of the gas feed used to prepare them. The Tennent invention provided access to smaller diameter fibrils, typically 35 to 700 Å (0.0035 to 0.070$\mu$) and to an ordered, "as grown" graphenic surface. Fibrillar carbons of less perfect structure, but also without a pyrolytic carbon outer layer have also been grown.

U.S. Pat. No. 5,171,560 to Tennent et al., hereby incorporated by reference, describes carbon fibrils free of thermal overcoat and having graphitic layers substantially parallel to the fibril axes such that the projection of said layers on said fibril axes extends for a distance of at least two fibril diameters. Typically, such fibrils are substantially cylindrical, graphitic nanotubes of substantially constant diameter and comprise cylindrical graphitic sheets whose c-axes are substantially perpendicular to their cylindrical axis. They are substantially free of pyrolytically deposited carbon, have a diameter less than 0.1$\mu$ and a length to diameter ratio of greater than 5.

These carbon fibrils free of thermal overcoat are of primary interest as starting materials in the present invention.

When the projection of the graphenic layers on the fibril axis extends for a distance of less than two fibril diameters, the carbon planes of the graphenic nanofiber, in cross section, take on a herring bone appearance. These are termed fishbone fibrils. Geus, U.S. Pat. No. 4,855,091, hereby incorporated by reference, provides a procedure for preparation of fishbone fibrils substantially free of a pyrolytic overcoat. These fibrils are also useful in the practice of the invention.

Carbon nanotubes of a morphology similar to the 4-catalytically grown fibrils described above have been grown in a high temperature carbon arc (Iijima, Nature 354 56 1991, hereby incorporated by reference). It is now generally accepted (Weaver, Science 265 1994, hereby incorporated by reference) that these arc-grown nanofibers have the same morphology as the earlier catalytically grown fibrils of Tennent. Arc grown carbon nanofibers are also useful in the invention.

Nanofiber Aggregates and Assemblages

High surface area nanofibers may be used in the formation of nanofiber aggregates and assemblages having properties and morphologies similar to those of aggregates of "as made" nanofibers, but with enhanced surface area. Aggregates of high surface area nanofibers, when present, are generally of the bird's nest, combed yarn or open net morphologies. The more "entangled" the aggregates are, the more processing will be required to achieve a suitable composition if a high porosity is desired. This means that the selection of combed yarn or open net aggregates is most preferable for the majority of applications. However, bird's nest aggregates will generally suffice.

The assemblage is another nanofiber structure suitable for use with the high surface area nanofibers of the present invention. An assemblage is a composition of matter comprising a three-dimensional rigid porous assemblage of a multiplicity of randomly oriented carbon nanofibers. An assemblage typically has a bulk density of from 0.001 to 0.50 gm/cc.

Coated Nanofibers and Methods of Preparing Same

The general area of this invention relates to nanofibers which are treated so as to increases the effective surface area of the nanofiber, and a process for making same.

Generally, a nanofiber having an increased surface area is produced by treating nanofiber in such a way that an extremely thin high surface area layer is formed. These increases the surface area, measured in $m^2/g$, of the nanofiber surface configuration by 50 to 300%. One method of making this type of coating is by application of a polymer to the surface of a nanofiber, then applying heat to the polymer layer to pyrolyze non-carbon constituents of the polymer, resulting a porous layer at the nanofiber surface. The pores resulting from the pyrolysis of the non-carbon polymer constituents effectively create increased surface area.

Figure 9:
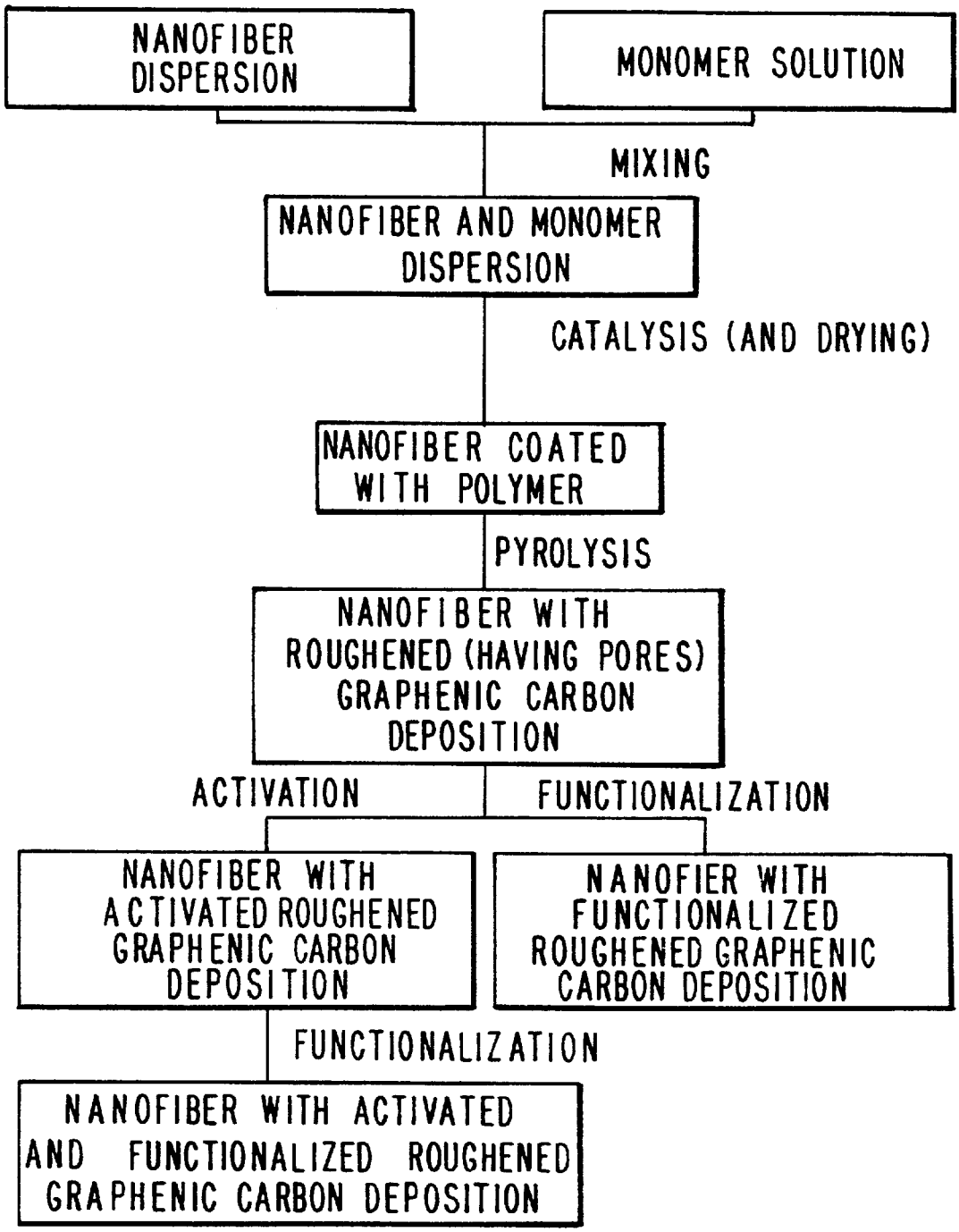
FIG. 9 is a flow diagram of the process for preparing fibrils coated with a carbonaceous thin layer.

A more detailed procedure for preparation of a nanofiber having increased surface area is illustrated at FIG. 9. The procedure consists of preparing a dispersion containing typically graphenic nanofibers and a suitable solvent, preparing a monomer solution, mixing the nanofiber dispersion with the monomer solution, adding a catalyst to the mixture, polymerizing the monomer to obtain a nanofiber coated with a polymeric coating substance and drying the polymeric coating substance. Finally, the coating substance can be pyrolyzed to result in a porous high surface area layer, preferably integral with nanofiber, thereby forming a nanofiber having a high surface area.

A preferred way to ensure that the polymer forms at the fibril surface is to initiate polymerization of the monomers at that surface. This can be done by adsorbing thereon conventional free radical, anionic, cationic, or organometallic (Ziegler) initiators or catalysts. Alternatively, anionoc and cationic polymerizations can be initiated electrochemically by applying appropriate potentials to the fibril surfaces. Finally, the coating substance can be pyrolyzed to result in a porous high surface area layer, preferably integral with nanofiber, thereby forming a nanofiber having a high surface area. Suitable technologies for preparation of such pyrolyzable polymers are given in U.S. Pat. No. 5,334,668, U.S. Pat. No. 5,236,686 and U.S. Pat. No. 5,169,929.

The resulting high surface area nanofiber preferably has a surface area greater than about 100 $m^2/g$, more preferably greater than about 200 $m^2/g$, even more preferably greater than about 300 $m^2/g$, and most preferably greater than about 400 $m^2/g$. The resulting high surface area nanofiber preferably has a carbon purity of 50%, more preferably 75%, even more preferably 90%, more preferably still 99%.

Figure 10:
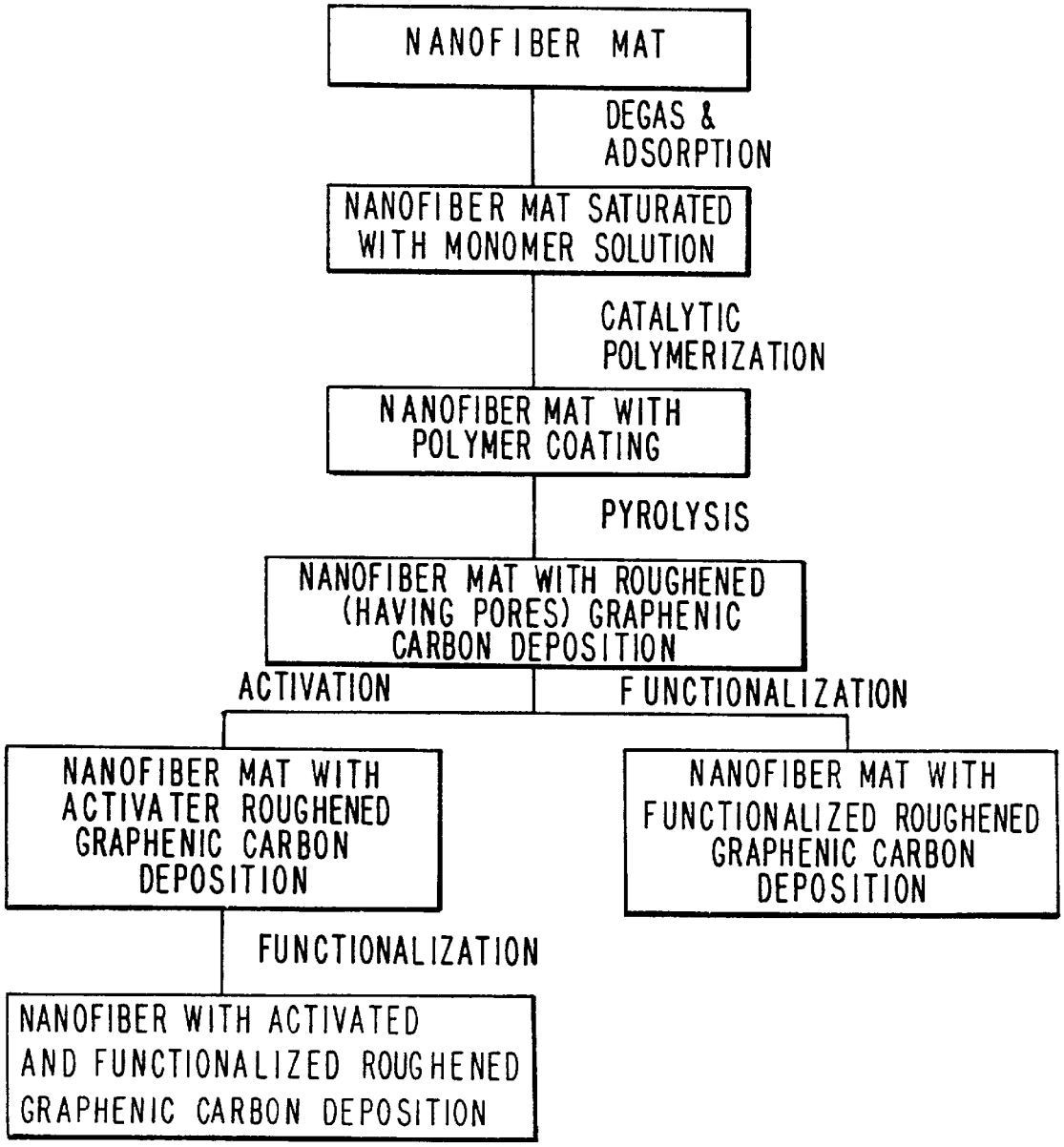
FIG. 10 is a flow diagram of the process for preparing fibril mats coated with a carbonaceous thin layer.

A procedure for the preparation of nanofiber mats with increased surface area is illustrated at FIG. 10. This procedure includes the steps of preparing a nanofiber mat, preparing a monomer solution, saturating the nanofiber mat with monomer solution under vacuum, polymerizing the monomers to obtain the a nanofiber mat coated with a polymeric coating substance, and pyrolyzing the polymer coating substance to obtain a high surface area nanofiber mat.

As used above, a "coating substance" refers to a substance with which a nanofiber is coated, and particularly to such a substance before it is subjected to a chemically altering step such as pyrolysis. For purposes of electrochemical applications of this invention, it is generally advantageous to select a coating substance which, when subjected to pyrolysis, forms a conductive nonmetallic thin coating layer. Typically, a coating substance is a polymer. Such a polymer deposits a high surface area layer of carbon on the nanofiber upon pyrolysis. Polymer coating substances typically used with this invention include, but are not limited to, phenalic-formaldehyde, polyacrylonitrile, styrene divinyl benzene, cellulosic, cyclotrimerized diethynyl benzene.

Activation

In addition to the methods of activation described in the "Methods of Functionalizing Section herein", the term "activation" also refers to a process for treating carbon, including carbon surfaces, to enhance or open an enormous number of pores, most of which have diameters ranging from 2–20 nanometers, although some micropores having diameters in the 1.2–2 range, and some pores with diameters up to 100 nanometers, may be formed by activation.

More specifically, a typical thin coating layer made of carbon may be activated by a number of methods, including (1) selective oxidation of carbon with steam, carbon dioxide, flue gas or air, and (2) treatment of carbonaceous matter with metal chlorides (particularly zinc chloride) or sulfides or phosphates, potassium sulfide, potassium thiocyanate or phosphoric acid.

Activation of the layer of a nanofiber is possible without diminishing the surface area enhancing effects of the high surface area layer resulting from pyrolysis. Rather, activation serves to further enhance already formed pores and create new pores on the thin coating layer.

A discussion is activation is found at Patrick, J. W. ed. *Porosity in Carbons: Characterization and Applications*, Halsted 1995.

Functionalized Nanofibers

After pyrolysis, or after pyrolysis and subsequent activation, the increased effective surface area of the nanofiber may be functionalized, producing nanofibers whose surface has been reacted or contacted with one or more substances to provide active sites thereon for chemical substitution, physical adsorption or other intermolecular or intramolecular interaction among different chemical species.

Although the high surface area nanofibers of this invention are not limited in the type of chemical groups with which they may be functionalized, the high surface area nanofibers of this invention may, by way of example, be functionalized with chemical groups such as those described below.

According to one embodiment of the invention, the nanofibers are functionalized and have the formula $$[C_nH_L]R_m$$

where n is an integer, L is a number less than 0.1 n, m is a number less than 0.5 n, each of R is the same and is selected from $SO_3H$, COOH, $NH_2$, OH, O, CHO, CN, COCl, halide, COSH, SH, R', COOR', SR', $SiR'_3$, $Si(OR')_yR'_{3-y}$, $Si(O—SiR'_2)OR'$, R", Li, $AlR'_2$, Hg—X, $TlZ_2$ and Mg-X, y is an integer equal to or less than 3, R' is alkyl, aryl, heteroaryl, cycloalkyl, aralkyl or heteroaralkyl, R" is fluoroalkyl, fluoroaryl, fluorocycloalkyl, fluoroaralkyl or cycloaryl, X is halide, and Z is carboxylate or trifluoroacetate.

The carbon atoms, $C_n$, are surface carbons of of the nanofiber or of the porous coating on the nanofiber. These compositions may be uniform in that each of R is the same or non-uniformly functionalized.

Also included as particles in the invention are functionalized nanotubes having the formula $$[C_nH_L][R'—R]_m$$

where n, L, m, R' and R have the same meaning as above.

In both uniformly and non-uniformly substituted nanotubes, the surface atoms $C_n$ are reacted. Most carbon atoms in the surface layer of a graphitic material, as in graphite, are basal plane carbons. Basal plane carbons are relatively inert to chemical attack. At defect sites, where, for example, the graphitic plane fails to extend fully around the surface, there are carbon atoms analogous to the edge carbon atoms of a graphite plane (See Urry, *Elementary Equilibrium Chemistry of Carbon,* Wiley, N.Y. 1989.) for a discussion of edge and basal plane carbons).

At defect sites, edge or basal plane carbons of lower, interior layers of the nanotube or coating may be exposed. The term surface carbon includes all the carbons, basal plane and edge, of the outermost layer of the nanotube or coating, as well as carbons, both basal plane and/or edge, of lower layers that may be exposed at defect sites of the outermost layer. The edge carbons are reactive and must contain some heteroatom or group to satisfy carbon valency.

The substituted nanotubes described above may advantageously be further functionalized. Such compositions include compositions of the formula $$[C_nH_L]A_m$$

where the carbons are surface carbons of a nanofiber or coating, n, L and m are as described above, A is selected from

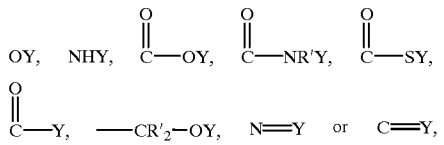

Y is an appropriate functional group of a protein, a peptide, an enzyme, an antibody, a nucleotide, an oligonucleotide, an antigen, or an enzyme substrate, enzyme inhibitor or the transition state analog of an enzyme substrate or is selected from R'—OH, R'—$NH_2$, R'SH, R'CHO, R'CN, R'X, $R'SiR'_3$, $R'Si(OR')_yR'_{3-y}$, $R'Si(O—SiR'_2)OR'$, R'—R", R'—N—CO, $(C_2H_4O)_wH$, $(C_3H_6O)_wH$, $(C_2H_4O)_w$—R', $(C_3H_6O)_w$—R' and R', and w is an integer greater than one and less than 200.

The functional nanotubes of structure $$[C_nH_L][R'—R]_m$$

may also be functionalized to produce compositions having the formula $$[C_nH_L][R'—A]_m$$

where n, L, m, R' and A are as defined above.

The nanofibers of the invention also include nanotubes upon which certain cyclic compounds are adsorbed. These include compositions of matter of the formula $$[C_nH_L][X—R_a]_m$$

where n is an integer, L is a number less than 0.1 n, m is less than 0.5 n, a is zero or a number less than 10, X is a polynuclear aromatic, polyheteronuclear aromatic or metallopolyheteronuclear aromatic moiety and R is as recited above.

Preferred cyclic compounds are planar macrocycles as described on p. 76 of Cotton and Wilkinson, *Advanced Organic Chemistry.* More preferred cyclic compounds for adsorption are porphyrins and phthalocyanines.

The adsorbed cyclic compounds may be functionalized. Such compositions include compounds of the formula $$[C_nH_L][X—A_a]_m$$

where m, n, L, a, X and A are as defined above and the carbons are surface carbons of a substantially cylindrical graphitic nanotube as described above.

Methods of Functionalizing Coated Nanofibers

The functionalized nanofibers of the invention can be directly prepared by sulfonation, cycloaddition to deoxygenated nanofiber surfaces, metallation and other techniques. When arc grown nanofibers are used, they may require extensive purification prior to functionalization. Ebbesen et al. (Nature 367 519 (1994)) give a procedure for such purification.

A functional group is a group of atoms that give the compound or substance to which they are linked characteristic chemical and physical properties. A functionalized surface refers to a carbon surface onto which such chemical groups are adsorbed or chemically attached so as to be available for electron transfer with the carbon, interaction with ions in the electrolyte or for other chemical interactions. Functional groups typically associated with this invention include, but are not limited to, functional groups selected from the group consisting of an alkalai metal, —$SO_3$, —R'COX, —R'$(COOH)_2$, —CN, —R'$CH_2$X, =O, —R'CHO, —R'CN, where R' is a hydrocarbon radical and X is —$NH_2$, -OH or a halogen. Methods of preparing surfaces functionalized with these and other groups are outlined below.

The nanofibers must be processed prior to contacting them with the functionalizing agent. Such processing must include either increasing surface area of the nanofibers by deposition on the nanofibers of a porous conducting non-metallic thin coating layer, typically carbon or activation of this surface carbon, or both.

Although several of the following examples and preparations were performed using aggregated nanofibers, it is believed that the same examples and preparations may be performed with non-aggregated nanofibers or other nanofibers.

1. Sulfonation

Background techniques are described in March, J. P., *Advanced Organic Chemistry, 3rd Ed.* Wiley, New York 1985; House, H., *Modern Synthetic Reactions, 2nd Ed., Benjamin/Cummings, Menlo Park, Calif.* 1972.

Activated C-H (including aromatic C-H) bonds can be sulfonated using fuming sulfuric acid (oleum), which is a solution of conc. sulfuric acid containing up to 20% $SO_3$. The conventional method is via liquid phase at T~80° C. using oleum; however, activated C-H bonds can also be sulfonated using $SO_3$ in inert, aprotic solvents, or $SO_3$ in the vapor phase. The reaction is:

$$—C—H+SO_3 \rightarrow —C—SO_3H$$

Over-reaction results in formation of sulfones, according to the reaction:

$$2—C—H+SO_3 \rightarrow —C—SO_2—C—+H_2O$$

2. Additions to Oxide-Free Nanofiber Surfaces

Background techniques are described in Urry, G., *Elementary Equilibrium Chemistry of Carbon,* Wiley, N.Y. 1989.

The surface carbons in nanofibers behave like graphite, i.e., they are arranged in hexagonal sheets containing both basal plane and edge carbons. While basal plane carbons are relatively inert to chemical attack, edge carbons are reactive and must contain some heteroatom or group to satisfy carbon valency. Nanofibers also have surface defect sites which are basically edge carbons and contain heteroatoms or groups.

The most common heteroatoms attached to surface carbons of nanofibers are hydrogen, the predominant gaseous component during manufacture; oxygen, due to its high reactivity and because traces of it are very difficult to avoid; and $H_2O$, which is always present due to the catalyst. Pyrolysis at −1000° C. in a vacuum will deoxygenate the surface in a complex reaction with an unknown mechanism. The resulting nanofiber surface contains radicals in a $C_1$–$C_4$ alignment which are very reactive to activated olefins. The surface is stable in a vacuum or in the presence of an inert gas, but retains its high reactivity until exposed to a reactive gas. Thus, nanofibers can be pyrolyzed at −1000° C. in vacuum or inert atmosphere, cooled under these same conditions and reacted with an appropriate molecule at lower temperature to give a stable functional group. Typical examples are:

$$\text{Nanofiber-O} \xrightarrow{1000^\circ\,\text{C.}} \text{Reactive Nanofiber Surface (RNS)} + 2\,CO + CO_2$$

followed by:

$$\text{RNS} + CH_2{=}CHCOX \xrightarrow{\text{Room Temp - 250° C.}} \text{Nanofiber-R'COX}\quad X{=}OH,\ —Cl,\ —NH_2,\ —H$$

RNS+Maleic anhydride→Nanofiber-R'$(COOH)_2$
RNS+Cyanogen→Nanofiber—CN
RNS+$CH_2$=CH—$CH_2$X→Nanofiber-R'$CH_2$X
X▽—$NH_2$,—OH, -Halogen
RNS+$H_2O$→Nanofiber=O (quinoidal)
RNS+$O_2$→Nanofiber=O (quinoidal)
RNS+$CH_2$=CHCHO→Nanofiber-R'CHO (aldehydic)
RNS+$CH_2$=CH—CN→Nanofiber-R'CN
RNS+$N_2$→Nanofiber-(aromatic nitrogen)
where R' is a hydrocarbon radical (alkyl, cycloalkyl, etc.)

3. Metallation

Background techniques are given in March, *Advanced Organic Chemistry,* 3rd ed., p. 545.

Aromatic C-H bonds can be metallated with a variety of organometallic reagents to produce carbon-metal bonds (C-M). M is usually Li, Be, Mg, Al, or Tl; however, other metals can also be used. The simplest reaction is by direct displacement of hydrogen in activated aromatics:

1. Nanofiber-H+R-Li→Nanofiber-Li+RH
   The reaction may require additionally, a strong base, such as potassium t-butoxide or chelating diamines. Aprotic solvents are necessary (paraffins, benzene).
2. Nanofiber-H+$AlR_3$→Nanofiber-$AlR_2$+RH
3. Nanofiber-H+Tl$(TFA)_3$→Nanofiber-Tl$(TFA)_2$+HTFA
   TFA=Trifluoroacetate HTFA=Trifluoroacetic acid The metallated derivatives are examples of primary singly-functionalized nanofibers. However, they can be reacted further to give other primary singly-functionalized nanofibers. Some reactions can be carried out sequentially in the same apparatus without isolation of intermediates.

4.

Nanofiber-M + $O_2$ ----→ Nanofiber-OH + MO  M = Li, Al

Nanofiber-M + S ---$H^+$--→ Nanofiber-SH + $M^+$

Nanofiber-M + $X_2$ ----→ Nanofiber-X + MX  X = Halogen

Nanofiber-M + $CH_3ONH_2$•Hcl ---catalyst, ether--→ Nanofiber-$NH_2$ + $MOCH_3$

Nanofiber-Tl$(TFA)_2$ + NaOH ---catalyst--→ Nanofiber-OH

Nanofiber-Tl$(TFA)_2$ + $NH_3OH$ ---catalyst--→ Nanofiber-$NH_2$ + HTFA

Nanofiber-Tl$(TFA)_2$ + aq. KCN ----→ Nanofiber-CN + TlTFA + KTFA

Nanofiber-CN + $H_2$ ----→ Nanofiber-$CH_2$—$NH_2$

A nanofiber can also be metallated by pyrolysis of the coated nanofiber in an inert environment followed by exposure to alkalai metal vapors:

Nanofiber+pyrolysis→Nanofiber (with "dangling" orbitals)+alkalai metal vapor (M)→Nanofiber-M

4. Derivatized Polynuclear Aromatic, Polyheteronuclear Aromatic and Planar Macrocyclic Compounds The graphenic surfaces of nanofibers allow for physical adsorption of aromatic compounds. The attraction is through van der Waals forces. These forces are considerable between multi-ring heteronuclear aromatic compounds and the basal plane carbons of graphenic surfaces. Desorption may occur under conditions where competitive surface adsorption is possible or where the adsorbate has high solubility.

5. Chlorate or Nitric Acid Oxidation

Literature on the oxidation of graphite by strong oxidants such as potassium chlorate in conc. sulfuric acid or nitric acid, includes R. N. Smith, *Ouarterly Review* 13, 287 (1959); M. J. D. Low, *Chem. Rev.* 60, 267 (1960)). Generally, edge carbons (including defect sites) are attacked to give mixtures of carboxylic acids, phenols and other oxygenated groups. The mechanism is complex involving radical reactions.

6. Secondary Derivatives of Functionalized Nanofibers Carboxylic Acid-functionalized Nanofibers The number of secondary derivatives which can be prepared from just carboxylic acid is essentially limitless. Alcohols or amines are easily linked to acid to give stable esters or amides. If the alcohol or amine is part of a di- or poly-functional molecule, then linkage through the O- or NH-leaves the other functionalities as pendant groups. Typical examples of secondary reagents are:

| GENERAL FORMULA | PENDANT GROUP | EXAMPLES |
|---|---|---|
| HO—R, R = alkyl, aralkyl, aryl, fluoroethanol, | R— | Methanol, phenol, trifluorocarbon, OH-terminated |

-continued

| GENERAL FORMULA | PENDANT GROUP | EXAMPLES |
|---|---|---|
| polymer, $SiR'_3$ | | Polyester, silanols |
| $H_2N$—R = same as above | R— | Amines, anilines, fluorinated amines, silylamines, amine terminated polyamides |
| Cl—$SiR_3$ | $SiR_3$— | Chlorosilanes |
| HO—R—OH, R = alkyl, aralkyl, $CH_2O$— | HO— | Ethyleneglycol, PEG, Pentaerythritol, bis-Phenol A |
| $H_2N$—R—$NH_2$, R = alkyl, aralkyl | $H_2N$— | Ethylenediamine, polyethyleneamines |
| X—R—Y, R = alkyl, etc; X = OH or $NH_2$; Y = SH, CN, C=O, CHO, alkene, alkyne, aromatic, heterocycles | Y— | Polyamine amides, Mercaptoethanol |

The reactions can be carried out using any of the methods developed for esterifying or aminating carboxylic acids with alcohols or amines. Of these, the methods of H. A. Staab, Angew. Chem. Internat. Edit., (1), 351 (1962) using N,N'-carbonyl diimidazole (CDI) as the acylating agent for esters or amides, and of G. W. Anderson, et al., J. Amer. Chem. Soc. 86, 1839 (1964), using N-Hydroxysuccinimide (NHS) to activate carboxylic acids for amidation were used.

N,N'-Carbonyl Diimidazole

1. R-COOH+Im-CO-Im→R-CO-Im+Him+$CO_2$, Im=Imidazolide, Him=Imidazole

2.

R—CO—Im + R'OH ---NaOEt--→ R—CO—OR' + Him

Amidation of amines occurs uncatalyzed at RT. The first step in the procedure is the same. After evolution of $CO_2$, a stoichiometric amount of amine is added at RT and reacted for 1–2 hours. The reaction is quantitative. The reaction is:

3. R-CO-Im+R'$NH_2$→R—CO—NHR+Him

N-Hydroxysuccinimide

Activation of carboxylic acids for amination with primary amines occurs through the N-hydroxysuccinamyl ester; carbodiimide is used to tie up the water released as a substituted urea. The NHS ester is then converted at RT to the amide by reaction with primary amine. The reactions are:

1. R-COOH+NHS+CDI→R-CONHS+Subst. Urea
2. R-CONHS+R'$NH_2$→R—CO—NHR'

Silylation

Trialkylsilylchlorides or trialkylsilanols react immediately with acidic H according to:

R-COOH+Cl-$SiR'_3$→R-CO-$SiR'_3$+Hcl

Small amounts of Diaza-1,1,1-bicyclooctane (DABCO) are used as catalysts. Suitable solvents are dioxane and toluene.

Sulfonic Acid-Functionalized Nanofibers

Aryl sulfonic acids, as prepared in Preparation A can be further reacted to yield secondary derivatives. Sulfonic acids can be reduced to mercaptans by $LiAlH_4$ or the combination of triphenyl phosphine and iodine (March, J. P., p. 1107). They can also be converted to sulfonate esters by reaction with dialkyl ethers, i.e., Nanofiber—$SO_3H$+R—O—R→Nanofiber—$SO_2OR$+ROH Nanofibers Functionalized by Electrophillic Addition to Oxygen-Free Nanofiber Surfaces or by Metallization The primary products obtainable by addition of activated electrophiles to oxygen-free nanofiber surfaces have pendant —COOH, —COCl, —CN, —$CH_2NH_2$, —$CH_2OH$, —$CH_2$-Halogen, or HC═O. These can be converted to secondary derivatives by the following:

Nanofiber-COOH→see above.

Nanofiber-COCl (acid chloride)+HO-R-Y→F-COO-R-Y (Sec. 4/5)

Nanofiber-COCl+$NH_2$-R-Y→F-CONH-R-Y

Nanofiber-CN+$H_2$→F-$CH_2$-$NH_2$

Nanofiber-$CH_2NH_2$+HOOC-R-Y→F-$CH_2$NHCO-R-Y

Nanofiber-$CH_2NH_2$+O═CR-R'Y→F-$CH_2$N═CR-R'-Y

Nanofiber-$CH_2$H+O(COR-Y)$_2$→F-$CH_2$OR-Y

Nanofiber-$CH_2$OH+HOOC-R-Y→F-$CH_2$OCOR-Y

Nanofiber-$CH_2$-Halogen+Y→F-$CH_2$-Y+$X^-$Y=$NCO^-$, —$OR^-$

Nanofiber-C═O+$H_2$N-R-Y→F-C═N-R-Y

Nanofibers Functionalized by Adsorption of Polynuclear or Polyheteronuclear Aromatic or Planar Macrocyclic Compounds Dilithium phthalocyanine: In general, the two $Li^+$ ions are displaced from the phthalocyanine (Pc) group by most metal (particularly multi-valent) complexes. Therefore, displacement of the $Li^+$ ions with a metal ion bonded with non-labile ligands is a method of putting stable functional groups onto nanofiber surfaces. Nearly all transition metal complexes will displace $Li^+$ from Pc to form a stable, non-labile chelate. The point is then to couple this metal with a suitable ligand.

Cobalt (II) Phthalocyanine

Cobalt (II) complexes are particularly suited for this. $Co^{++}$ ion can be substituted for the two $Li^+$ ions to form a very stable chelate. The $Co^{++}$ ion can then be coordinated to a ligand such as nicotinic acid, which contains a pyridine ring with a pendant carboxylic acid group and which is known to bond preferentially to the pyridine group. In the presence of excess nicotinic acid, Co(II)Pc can be electrochemically oxidized to Co(III)Pc, forming a non-labile complex with the pyridine moiety of nicotinic acid. Thus, the free carboxylic acid group of the nicotinic acid ligand is firmly attached to the nanofiber surface.

Other suitable ligands are the aminopyridines or ethylenediamine (pendant $NH_2$), mercaptopyridine (SH), or other polyfunctional ligands containing either an amino- or pyridyl-moiety on one end, and any desirable function on the other.

Further detailed methods of functionalizing nanofibers are described at U.S. patent application Ser. No. 08/352400 filed on Dec. 8, 1994 for FUNCTIONALIZED NANOTUBES, incorporated herein by reference.

Rigid High Surface Area Structures

The coated nanofibers of this invention can be incorporated into three-dimensional catalyst support structures (see U.S. patent application for RIGID POROUS CARBON STRUCTURES, METHODS OF MAKING, METHODS OF USING AND PRODUCTS CONTAINING SAME, filed concurrently with this application, the disclosure of which is hereby incorporated by reference).

Products Containing High Surface Area Nanofibers

High surface area nanofibers or nanofiber aggregates or assemblages may be used for any purpose for which porous media are known to be useful. These include filtration, electrodes, catalyst supports, chromatography media, etc. For some applications unmodified nanofibers or nanofiber aggregates or assemblages can be used. For other applications, nanofibers or nanofiber aggregates or assemblages are a component of a more complex material, i.e. they are part of a composite. Examples of such composites are polymer molding compounds, chromatography media, electrodes for fuel cells and batteries, nanofiber supported catalyst and ceramic composites, including bioceramics like artificial bone.

Disordered Carbon Anodes

Various carbon coating structures have also been used in the manufactutre of batteries. Currently available lithium ion batteries use an intercalatable carbon as the anode. The maximum energy density of such batteries corresponds to the intercalation compound $C_5Li$, with a specific capacity of 372 A-hours/kg. A recent report by Sato, et al. (Sato, K., et al., A Mechanism of Lithium Storage in Disordered Carbons, Science, 264, 556 (1994) describes a new mode of Li storage in carbon that offers the potential for significant increases in specific capacity. Sato, et al. have shown that a polymer derived disordered carbon is capable of storing lithium at nearly three times the density of intercalate, i.e., $C_2Li$, and appears to have measured capacities of 1000 A-hours/kg.

These electrodes are made by carbonization of polyparaphenylene (PPP). PPP polymers have been previously synthesized and studied both because they are conducting and because they form very rigid, straight chain polymers interesting as components of dual polymers self reinforced systems. NMR data suggests that the resulting carbon is mainly condensed aromatic sheets, but x-ray diffraction data suggests very little order in the structure. The intrinsic formula is $C_2H$.

Although possibly useful, the reference is insufficient data to compute all the key parameters of this electrode. Additionally, one suspects from the synthesis and from the published electron micrographs that the electrodes so produced are quite dense with little porosity or microstructure. If so, one would anticipate a rather poor power density, which cannot be deduced directly from the paper.

Finally, it is clear that at least two modes of Li storage are operative, and one is the classic intercalate $C_6Li$. The net achieved is about $C_4Li$. Depending on what one postulates is the way of alternative structures and how trusting one is of the deconvolution, different ratios of $C_6Li$ and the denser storage species can be calculated. Clearly, however, a more selective storage of the desired species would lead to a higher energy density.

Another aspect of the invention relates to electrodes for both the anode and cathode of the lithium ion battery. Ideally, both electrodes will be made from the same starting material—electrically conductive pyrolized polymer crystals in a porous fibril web. By imposing the high surface area of the fibrils on the system, of higher power density associated with increased surface is achievable.

The anode chemistry would be along the lines described by Sato, et al. Cathode chemistry would be either conventional via entrapped or supported spinel or by a redox polymer. Thus, preparation of both electrodes may begin with a polymerization.

Polymerization

According to one embodiment, the electrodes would be produced by electropolymerization of PPP on a preformed fibril electrode. PPP was first grown electrochemically on graphite by Jasinski. (Jasinski, R. and Brilmyer, G., The Electrochemistry of Hydrocarbons in Hydrogen Fluoride/Antimony (V) fluroide: some mechanistic conclusoins concerning the super acid "catalyzed" condensation of hydrocarbons, J. Electrochem. Soc. 129 (9) 1950 (1982). Other conductive polymers like polypyrrole and polyaniline can be similarly grown. Given the uncertainty as to the optimum disordered carbon structure described by Sato, et al., and considering redox polymer cathodes, this invention embodies making and pyrolizing a number of materials and compare their carbonization products to. pyrolized PPP.

It is possible to electropolymerized pyrrole in situ in performed fibril mat electrodes to form fibril/polypyrrole polymer composites. The polypyrrole becomes permanently bound to the fibril mat, although the uniformity of coverage is not known. Electrochemical measurements do demonstrate that electrode porosity is maintained, even at high levels of polypyrrole deposition. Importantly, both the amount and rate of deposition can be controlled electrochemically.

Beside conductive polymers that can be electropolymerized, other high C/H polymers are also of interest. One candidate family, of particular interest as cathode materials, can be formed by oxidative coupling of acetylene by cupric amines. The coupling has usually been used to make diacetylene from substitute acetylene:

$$2RC{=}CH+{}_1/^2O_2 \rightarrow RC{=}C{-}C{=}C{-}R+H_2O$$

Acetylene itself reacts to uncharacterized intractable "carbons". The first reaction product must be butadiyne, HC═C—C═CH which can both polymerize and loose more hydrogen by further oxidative coupling. Systematic study of the effect of reaction variables could lead to conductive hydrocarbon with high H/C ratios for the cathode material. It may be possible to make products with high content of the ladder polymer, $(C_4H_2)$. Cyanogen, N═C—C═N, for example, readily polymerizes to intractable solids believed to consist mostly of the analogous ladder. Syntheses via organometallic precursors are also available.

Like the pyrolyzed conductive polymers, these acetylenics may be pyrolized and evaluated against pyrolized PPP, but primary interest in this family of materials is oxidation to high O/C cathode materials.

The structural features in Sato et al.'s pyrolized PP which make possible lithium loadings as high as $C_2Li$ are not known. There is some evidence that the extra lithium beyond $C_6Li$ is stored in small cavities in the carbon or some could be bound to the edge carbons already carrying hydrogens in $C_4H$.

It is possible to vary both polymerization and pyrolysis conditions on PPP and to screen other pyrolized conductive polymer/fibril composites for ability to store lithium. A more controlled polymerization could result in a greater selectivity for $C_2Li$. The preferable embodiment is a host carbon which forms $C_2Li$ on charging with minimum diffusional distance and hence high charge and discharge rates.

Pyrolysis variables include; time, temperature and atmosphere and the crystal dimension of the starting PPP or other polymer. Fibrils are inert to mild pyrolysis conditions.

There are two distinct paths to nanotube based cathodes consistent with increased power density: redox polymer cathodes, which have the potential to further improve energy density as well as power density and conventional spinel chemistry carried out on a nanoscale on small "islands" of electroactive material inside a fibril mat electrode.

To form the cathode, the PPP may be oxidized anodically in strong acid containing small amounts of water using conditions which form graphite oxide without breaking carbon-carbon bonds. The preferred embodiment outcome would be conversion of PPP molecules to $(C_6O_4)_n$ where n is the number of phenylene rings in the original polyphenylene.

If the single carbon-carbon bonds in the PPP are broken in the oxidation, it will be necessary to find the minimum conditions for carbonization of the PPP which permits the anodic oxidation without destroying the carbon-carbon network.

Sato, et al. describe a pyrolysis product whose composition was $(C_4H_2)_n$. This may not be optimum for the cathode where the goal is maximizing the number of oxides which replace H in the anodic oxidation because these will be quinonic oxygens. The potential of analogous quinone/hydroquinone complexes is ca. one volt—comparable to the $Mn_{+3}/Mn_{+4}$ couple in spinels.

The coated nanofibers of this invention can be incorporated into capacitors (see U.S. patent application for GRAPHITIC NANOTUBES IN ELECTROCHEMICAL CAPACITORS, filed concurrently with this application, the disclosure of which is hereby incorporated by reference).

The coated nanofibers of this invention can be incorporated into rigid structures (see U.S. patent application for RIGID POROUS CARBON STRUCTURES, METHODS OF MAKING, METHODS OF USING AND PRODUCTS CONTAINING SAME, filed concurrently with this application, the disclosure of which is hereby incorporated by reference).

The terms and expressions which have been employed are used as terms of description and not of limitations, and there is no intention in the use of such terms or expressions of excluding any equivalents of the features shown and described as portions thereof, its being recognized that various modifications are possible within the scope of the invention.

What is claimed is:

1. A high surface area carbon nanofiber, comprising:

a nanofiber, having an outer surface having an effective surface area; and a high surface area layer formed onto said outer surface of said nanofiber;

wherein said high surface area layer contains pores including mesopores, macropores or micropores, and wherein at least a portion of said pores are of a sufficient size to increase the effective surface area of said nanofiber.

2. The high surface area nanofiber recited in claim 1, wherein the surface of said high surface area carbon nanofiber is substantially free of micropores.

3. The high surface area nanofiber recited in claim 1, wherein said high surface area layer is produced by pyrolyzing a polymeric coating substance onto the outer surface of said nanofiber, and wherein said polymeric coating substance is capable of carbonizing at a temperature below the temperature at which said polymeric coating substance melts.

4. The high surface area nanofiber recited in claim 1, wherein said high surface area layer is formed by pyrolyzing a polymeric coating substance selected from the group consisting of phenalics-formaldehyde, polyacrylonitrile, styrene divinyl benzene, cellulosic polymers, and cyclotrimerized diethynyl benzene.

5. The high surface area nanofibers recited in claim 1, wherein said high surface area layer is formed by chemically modifying a polymer coating substance.

6. The high surface area nanofiber recited in claim 1, wherein said high surface area layer is applied to said nanofiber by an evaporation technique.

7. The high surface area nanofiber recited in claim 1, wherein said pores have a minimum length and width of about 20 Å.

8. The high surface area nanofiber recited in claim 1, wherein said pores have a maximum depth of 200 Å.

9. The high surface area nanofiber recited in claim 1, wherein said pores have a maximum depth of 100 Å.

10. The high surface area nanofiber recited in claim 1, wherein the high surface area layer of said nanofiber is activated to form an activated surface.

11. The high surface area nanofiber recited in claim 1, wherein said high surface area nanofiber is functionalized.

12. The high surface area nanofiber recited in claim 1, wherein said high surface area nanofiber is functionalized with one or more functional groups selected from the group consisting of —$SO_3$, —R'COX, —R'$(COOH)_2$, —CN, —R'$CH_2$X, ═O, —R'CHO, —R'CN, and a graphenic analogue of one or more of

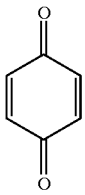

(quinone),

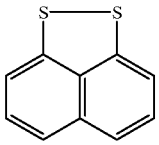

(1.8 napthaline disulfide),

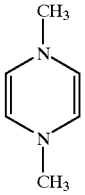

(N, N', dimethyl pyrazine),

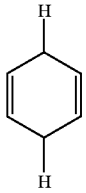

(Dihydrobenzene) and

-continued

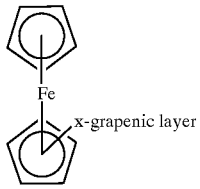

(Ferrocene)

wherein R' is a hydrocarbon radical, and wherein X is —$NH_2$, —OH or a halogen.

13. The high surface area nanofiber recited in claim 10, wherein the surface of said activated layer is functionalized.

14. The high surface area nanofiber recited in claim 1, wherein the effective surface area is increased by 50%.

15. The coated nanofiber recited in claim 1, wherein the effective surface area is increased by 150%.

16. The high surface area nanofiber recited in claim 1, wherein the effective surface area is increased by 300%.

17. The high surface area nanofiber recited in claim 1, wherein said nanofiber comprises carbon and the carbon purity of said nanofiber is about 90% by weight.

18. The high surface area nanofiber recited in claim 1, wherein the carbon purity of said nanofiber is about 99% by weight.

19. The high surface area nanofiber as recited in claim 1, wherein when said high surface area nanofiber has a cross-section of 65 angstroms, the effective surface area of said high surface area nanofiber is greater than 400 $m^2/g$.

20. The high surface area nanofiber recited in claim 1, wherein when said high area nanofiber has a cross-section of 130 angstroms, the effective surface area of said high surface area nanofiber is greater than 200 $m^2/g$.

21. The high surface area nanofiber as recited in claim 1, wherein when said high surface area nanofiber has a cross-section of 250 angstroms, the effective surface area of said high surface area nanofiber is greater than 100 $m^2/g$.

* * * * *